US005406362A

United States Patent [19]

Mills

[11] Patent Number: 5,406,362

[45] Date of Patent: Apr. 11, 1995

[54] PRESSURE ROLLER FUSER WITH COPY WRINKLE CONTROL

[75] Inventor: Borden H. Mills, Webster, N.Y.

[73] Assignee: Eastman Kodak Company, Rochester, N.Y.

[21] Appl. No.: 170,629

[22] Filed: Dec. 20, 1993

[51] Int. Cl.[6] ..... G03G 15/20

[52] U.S. Cl. ..... 355/285; 100/162 B; 271/273

[58] Field of Search ..... 355/285, 290, 295, 282; 100/162 B, 168, 169; 162/197, 270, 271; 492/6, 7, 2; 226/190, 194; 271/161, 188, 209, 272, 273, 274; 219/216, 469, 244; 34/454, 620

[56] References Cited

U.S. PATENT DOCUMENTS

| | | | |
|---|---|---|---|
| 4,104,963 | 8/1978 | Fortmann | 100/176 |
| 4,942,434 | 7/1990 | Nakai et al. | 355/290 |
| 4,943,831 | 7/1990 | Geraets et al. | 355/290 |
| 5,189,480 | 2/1993 | Hoover et al. | 355/282 |

FOREIGN PATENT DOCUMENTS

| | | | |
|---|---|---|---|
| 56-25768 | 3/1981 | Japan | 355/295 |
| 56-60471 | 5/1981 | Japan | 355/295 |
| 01-142779 | 6/1989 | Japan . | |
| 2-148078 | 6/1990 | Japan | 355/290 |
| 2-277089 | 11/1990 | Japan | 355/290 |
| 2037942 | 7/1980 | United Kingdom | 355/295 |

*Primary Examiner*—A. T. Grimley
*Assistant Examiner*—Nestor R. Ramirez
*Attorney, Agent, or Firm*—Leonard W. Treash

[57] ABSTRACT

A pressure roller fuser includes a member at the end of at least one of the rollers for extending the position for applying the loading force between the rollers away from the center of the roller to cause the roller to bend with respect to the other roller. The bending causes a spreading of the nip at the edges of the roller to reduce wrinkling of the sheets fed through the nip. The amount of bend can be varied by varying the position of the loading force with respect to the center of the rollers, thereby allowing adjustment of the flare of the nip according to ambient conditions or the life of the rollers.

3 Claims, 2 Drawing Sheets

PRESSURE ROLLER FUSER WITH COPY WRINKLE CONTROL

This invention relates to pressure roller fusing of toner images carried on a receiving sheet. More specifically, it relates to the reduction of wrinkling in a receiving sheet in the nip of a pressure roller fuser.

U.S. Pat. No. 5,189,480, granted Feb. 23, 1993 to Hoover shows a pressure roller fuser having a heated fusing roller which contacts a toner image to fuse it to a receiving sheet as the receiving sheet passes through a nip created between the fusing roller and a pressure roller. The fusing roller has a soft outer layer which is compressed by the pressure roller in the nip. In this fuser, the bearings of the fusing roller are held in a fixed position while the pressure roller is urged against the fusing roller by spring forces applied through the pressure roller's bearings.

Many roller fusers presently on the market taper one or both of the rollers to alter the shape of the nip along its length. Most commonly, the pressure roller is made wider on the ends than in the middle to widen the nip on the ends. This has a tendency to drive the edges of the sheet faster than the middle of the sheet. This compensates for certain dimensional irregularities due to humidity and generally reduces wrinkles and other artifacts.

If the taper is placed in the pressure roller and the fusing roller is compliant, the fusing roller will set, in time, to the taper and reduce its effect, encouraging premature replacement of the fusing roller. Similarly, in conditions of low relative humidity, it is possible to overdrive the edges and cause other image artifacts. Thus, a taper machined into one or both rollers in the factory does not adequately handle all conditions for its entire life.

SUMMARY OF THE INVENTION

It is an object of the invention to improve the wrinkle control of a pressure roller fuser for fixing toner images to a receiving sheet.

This and other objects are accomplished by a fuser having first and second rollers. Each of the rollers have opposite lateral ends and at least one of the rollers is compliant. The fuser includes means for urging the rollers together to form a nip into which the receiving sheet is fed, the nip having lateral (crosstrack) edges. The urging means includes means for applying a force to each end of at least the first roller, the force is applied at positions separated from the lateral edges of the nip sufficiently to bend the first roller with respect to the second roller to taper the nip and reduce wrinkling of the receiver sheet.

According to a preferred embodiment, the forces urging the rollers together are applied at a position substantially outside the edges of the nip rather than through the bearings. This is facilitated by a pair of L-shaped members. Each L-shaped member has a first leg that is attached to the roller and generally extends perpendicular to the axis of rotation of the roller. Preferably, it is attached to the roller at the beatings. A second leg extends parallel to the axis of rotation. It can extend toward or away from the center of the roller or, with a T-shaped design, it can extend in both directions. The force is applied to the second leg of the L-shaped member at a position separated from the first leg and, therefore, separated from the bearings.

A particular advantage of the preferred embodiment is that the position of application of the force can be varied to allow adjustment of the bending of the first roller and, thereby, adjustment of the taper in the nip. This adjustment can be made due to poor performance of the fuser which can be due to wear or heat set of one of the rollers or to unusual ambient conditions (usually too dry).

DESCRIPTION OF THE PREFERRED EMBODIMENT

Figure 1:
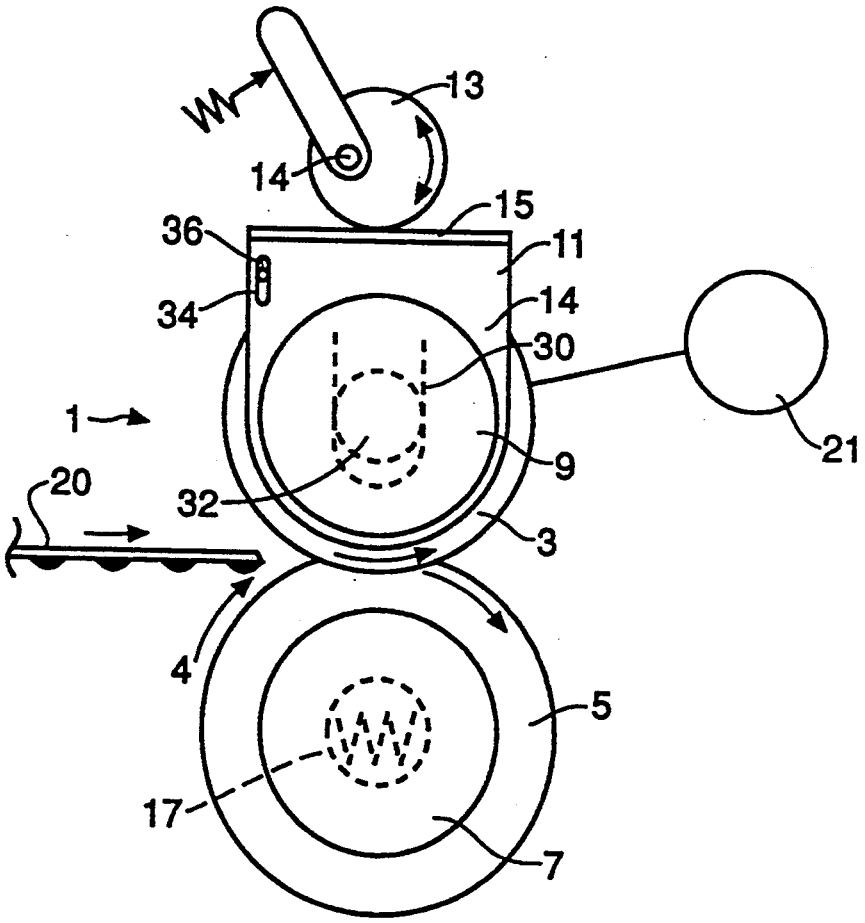
FIG. 1 is a side schematic of a fuser.

FIG. 1 shows a pressure roller fuser 1 having a fusing roller 5 and a pressure roller 3 which engage to form a nip 4 into which a receiving sheet 20 is fed. The receiving sheet has a toner image which contacts the fusing roller 5. Fusing roller 5 is heated by a lamp 17 and has a compliant outer layer. The compliant outer layer causes the nip 4 to have substantial width. The combination of heat and pressure in the nip fixes the toner image to the receiving sheet.

Typically, one of the rollers is vertically fixed between the mechanism plates of the fuser and the other is spring urged into engagement with it. In the example shown in FIG. 1, fusing roller 5 is fixed and pressure roller 3 is urged toward it by an urging or loading device shown schematically at 13, which will be explained more thoroughly later. Restriction of movement of the pressure roller 3 to vertical movement is provided by a slot 30 restricting a shaft 32, shown only in FIG. 1, and quite conventional.

Although both rollers can be driven to drive the receiving sheet 20 through the nip 4, in the device shown in FIG. 1, a motor 21 drives pressure roller 3 which, in turn, frictionally drives the fusing roller 5.

Figure 2:
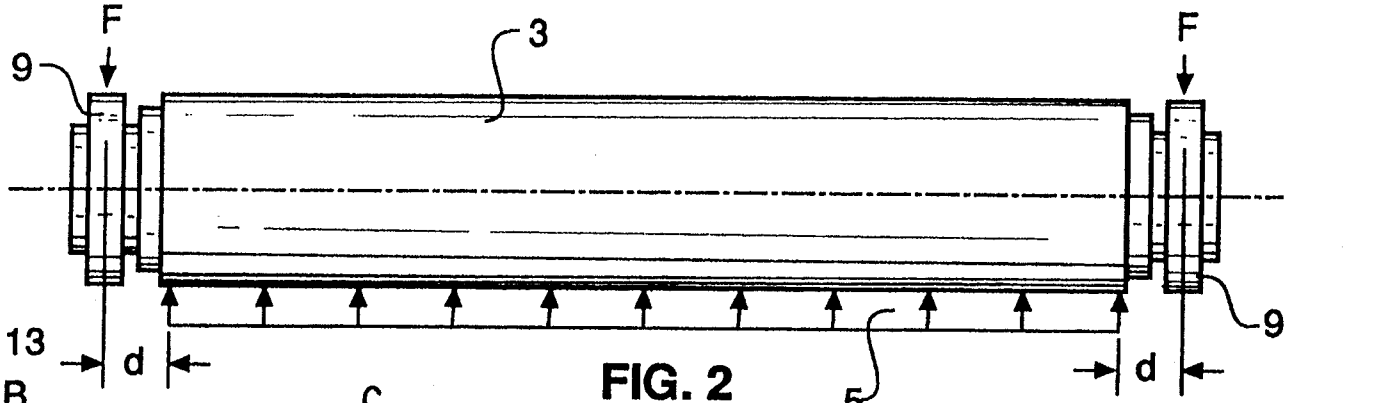
FIG. 2 (PRIOR ART)
FIG. 2 is a front view of a portion of a conventional fuser.

FIG. 2 shows a conventional roller, for example, pressure roller 3, which is loaded against a fusing roller 5 by the application of force through each of its bearings. Because the bearings are close to the ends of the rollers, this causes a generally even force across the nip. If the rollers themselves are not tapered, the width (in the intrack direction) is fairly constant the length of the roller. To reduce wrinkles, such rollers are commonly tapered and have their large diameter at the ends. Alteratively, the compliancy of the roller can be varied across its length to increase the width of the nip at the ends. These are well known expedients that have been in practice for more than 20 years. They are built into the rollers at the factory and are not adjustable in practice. They vary with the life of the roller.

Figure 3:
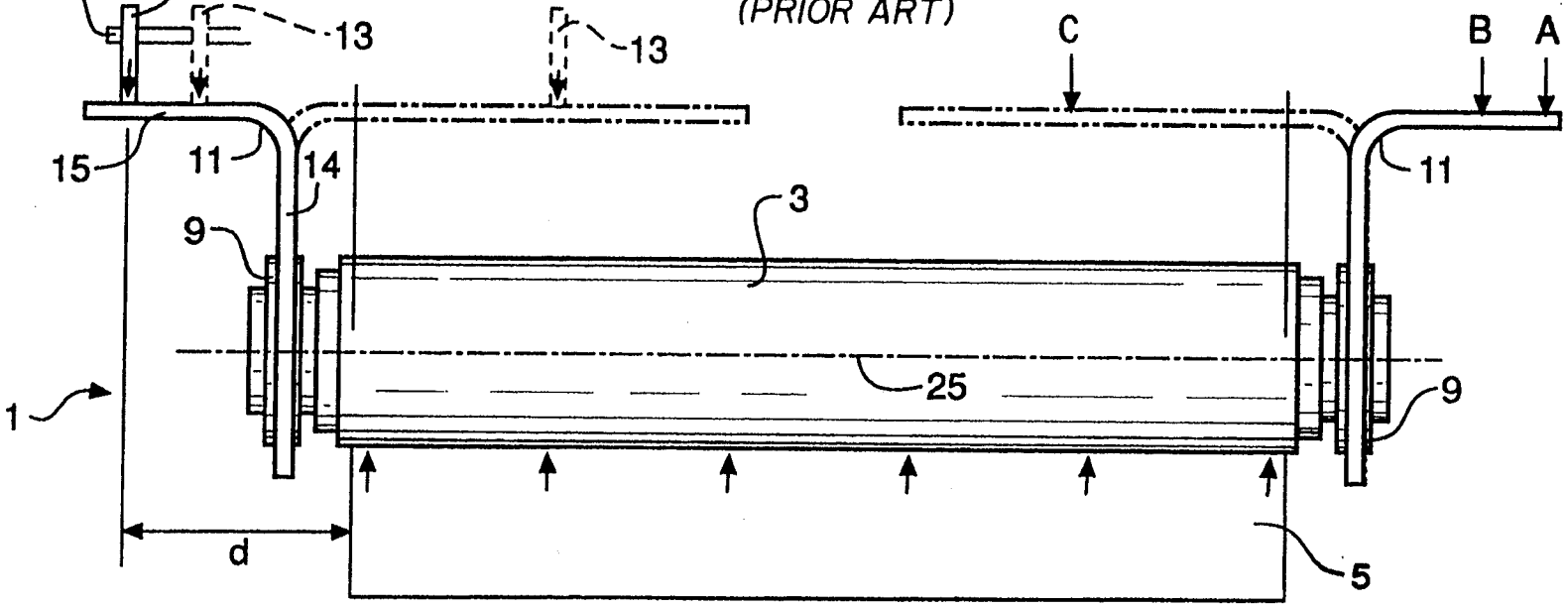
FIG. 3 is a front view of a portion of the fuser shown in FIG. 1.

According to FIGS. 1 and 3, if the crosstrack or lateral position of the loading force can be varied, a position can be found which will cause the roller to bend during use to also widen the nip at its lateral edges. As shown in FIG. 3, instead of applying the loading force directly through the bearings, it is applied to an L-shaped loading bracket 11. Loading bracket 11 has a first leg 14 which is fixed to a bearing 9 for roller 3. A second leg 15 extends parallel to the axis of rotation 25 of roller 3 either toward or away from the center of the roller. As shown in solid lines in FIG. 3, the second leg extends away from the center of roller 3.

The loading force is applied through a cam 13 at any of a variety of positions. As shown in FIG. 3 in solid lines, it is applied at position A which is substantially further from the lateral edge of the nip than when it is applied through the bearing 9, as shown in FIG. 2. This force, applied at each of the opposite ends of the roller, has a tendency to bend the roller, essentially around the edge of the nip. With the loading force at the position A, the tendency will be for the nip to be flared, similar to the result achieved with a conventional tapered nip. However, if the flare is too much, the loading force can be moved to position B (FIG. 3) and the flare reduced. Further, if a barrel-shaped nip is desired, the loading force can be moved to position C. As shown very schematically in FIG. 3, movement of the loading position from A to B can be accomplished, as shown somewhat oversimplified in FIG. 3 by moving cam 13 along a shaft 14 using appropriate set screws or the like.

Loading bracket 11 is shown as L-shaped with the second leg either toward the center (phantom) or away from the center of roller 3. Obviously, it could be T-shaped (a special case of L-shaped), giving complete flexibility between both flared and barrel-shaped nips.

It is important that L-shaped member 14 not have a tendency to rotate with pressure roller 3. This can be prevented by a number of mechanical structures. For example, a pin 36 and a slot 34 is shown in FIG. 1, which allows vertical movement of bracket 11 with shaft 32 but prevents rotational movement around axis of rotation 25 (FIG. 3).

At its most practical, the loading bracket 11, is as shown in solid lines in FIG. 3. The initial loading position may be somewhere between positions A and B. If the fuser is used in extremely dry conditions, better results may be achieved by moving toward B. As the extra width of the nip at the edges wears the fusing roller, it may be desirable to move the loading force toward A. An important advantage of the preferred embodiment of the invention is that it can be adjusted and is not set for life in the factory.

Note that either or both of the fusing roller and the pressure roller can be bent. The amount of bending resulting from a particular force at a particular position for a particular roller can be determined from textbook formulas based on the Young's modulus of the roll core material, the moment of inertia of the roller and its various dimensions. However, the actual position for best results in preventing wrinkles is best determined empirically with fine tuning accomplished by the adjustment of the force position as discussed above.

The invention has been described in detail with particular reference to a preferred embodiment thereof, but it will be understood that variations and modifications can be effected within the spirit and scope of the invention as described hereinabove and as defined in the appended claims.

I claim:

1. A pressure roller fuser for fixing toner images to a receiving sheet, said fuser comprising:

first and second rollers, each of said rollers having an axis of rotation and opposite lateral ends and at least one of the rollers being compliant, means for urging the rollers together to form a nip into which the receiving sheet is fed, the nip having lateral edges, said urging means including means for applying a force to each end of at least the first roller, said forces being applied at positions separated from the lateral edges of the nip sufficiently to bend the first roller with respect to the second roller to vary the width of the nip across the cross-track length of the nip and reduce wrinkling of the receiver sheet, and a pair of L-shaped members, one fixed to each end of the first roller, each L-shaped member having a leg perpendicular to the axis of rotation and fixed to the roller and a second leg extending toward or away from the center of the roller or both and having a surface for receiving the force applied by the urging means.

2. A fuser according to claim 1 wherein the positions at which the forces are applied are adjustable to vary the amount of bend of the first roller.

3. A pressure roller fuser for fixing toner images to a receiving sheet, said fuser comprising:

a pressure roller having an axis of rotation and opposite lateral ends and bearing means at each end, a fusing roller having a compliant outer layer, means for urging the rollers together to form a nip having lateral edges and into which a receiving sheet is fed, means for rotating the rollers to move the receiving sheet through the nip to fix the toner image to it, means for heating at least one of the rollers to provide a fixing heat in the nip, and first and second L-shaped members, each of said L-shaped members having a first leg generally perpendicular to the axis of rotation of the pressure roller and fixed to the bearing means at each of the opposite ends of the pressure roller, and a second leg extending generally parallel to the axis of rotation of the pressure roller and having a surface for receiving a force applied by the urging means.

* * * * *